US006126584A

United States Patent [19]

Zadravetz

[11] Patent Number: 6,126,584

[45] **Date of Patent: *Oct. 3, 2000**

[54] METHOD FOR FORMING A CONTAINER WITH CORRUGATED WALL

[76] Inventor: Robert B. Zadravetz, 5087 Horizon Ct., West Bend, Wis. 53095

[ * ] Notice: This patent issued on a continued prosecution application filed under 37 CFR 1.53(d), and is subject to the twenty year patent term provisions of 35 U.S.C. 154(a)(2).

[21] Appl. No.: 09/172,412

[22] Filed: Oct. 14, 1998

Related U.S. Application Data

[62] Division of application No. 08/862,231, May 23, 1997, Pat. No. 5,839,653, which is a continuation of application No. 08/682,826, Jul. 12, 1996, abandoned.

[51] Int. Cl.[7] ..... B31B 1/90

[52] U.S. Cl. ..... 493/109; 493/98; 493/111; 493/158; 493/185; 493/388; 493/463; 493/903; 493/906; 493/907; 229/403; 229/939

[58] Field of Search ..... 493/109, 108, 493/129, 156, 158, 185, 906, 907, 903, 464, 52, 84, 98, 386, 388, 463, 374, 111, 112; 229/403, 939

[56] References Cited

U.S. PATENT DOCUMENTS

| | | | |
|---|---|---|---|
| Re. 25,618 | 7/1964 | Goodman | 220/15 |
| 2,127,029 | 8/1938 | Hermanson | 229/87.08 |
| 2,181,035 | 11/1939 | White | 138/144 |
| 2,266,828 | 12/1941 | Sykes | 229/14 |
| 2,695,744 | 11/1954 | Gattuso | 229/14 |
| 2,853,222 | 9/1958 | Gallagher | 229/1.5 |
| 3,439,587 | 4/1969 | Sternau | 493/52 |
| 3,456,860 | 7/1969 | Jannick | 229/1.5 |
| 3,603,218 | 9/1971 | Ludder | 493/156 |
| 3,668,049 | 6/1972 | Silfverlin | 229/87.01 X |
| 4,373,928 | 2/1983 | Horton | 493/158 |
| 4,993,580 | 2/1991 | Smith | 220/443 |
| 5,092,485 | 3/1992 | Lee | 220/441 |
| 5,203,491 | 4/1993 | Marx et al. | 493/158 |
| 5,205,473 | 4/1993 | Coffin, Sr. | 229/1.5 |
| 5,226,585 | 7/1993 | Varano | 229/1.5 |
| 5,326,019 | 7/1994 | Wolff | 229/1.5 |
| 5,363,982 | 11/1994 | Sadlier | 220/441 |
| 5,385,260 | 1/1995 | Gatcomb | 220/415 |
| 5,431,619 | 7/1995 | Bacon et al. | 493/158 |
| 5,460,323 | 10/1995 | Titus | 229/403 |
| 5,547,124 | 8/1996 | Mueller | 229/403 |
| 5,772,111 | 6/1998 | Kirsch | 229/403 |

*Primary Examiner*—Brian L. Johnson
*Assistant Examiner*—Matt Luby
*Attorney, Agent, or Firm*—Quarles & Brady

[57] ABSTRACT

A method of forming a paper container uses a three ply corrugated material having at least one inner or outer sheet of paper that may be stretched or compressed circumferentially to permit subsequent rolling of the corrugated material about a mandrel. A flattening of the upper and lower edges of the corrugated material permit rolling and seaming operations to be used to assemble the bottom to the cup and to form a lip in the upper edge.

5 Claims, 3 Drawing Sheets

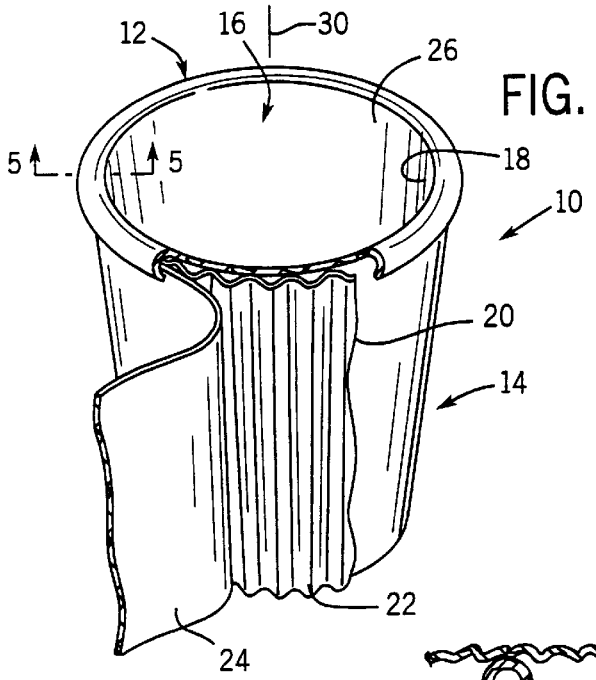
FIG. 1
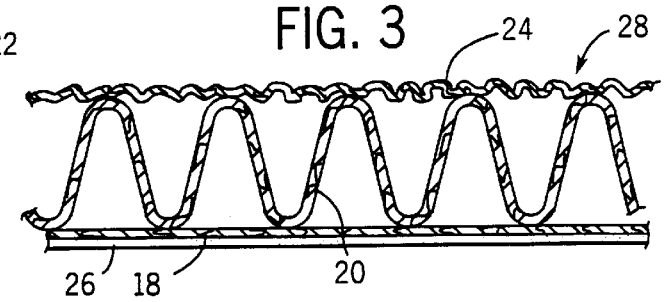
FIG. 3
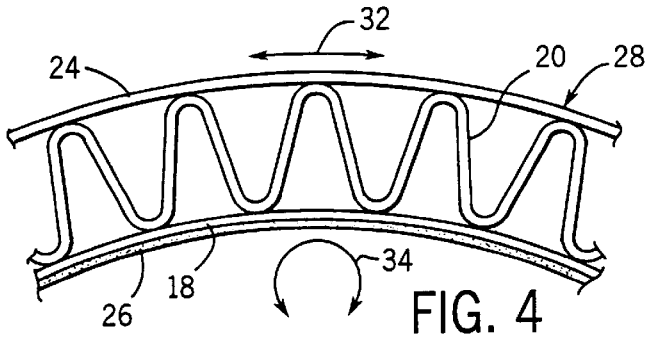
FIG. 4
FIG. 11
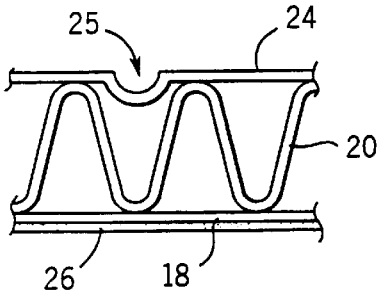
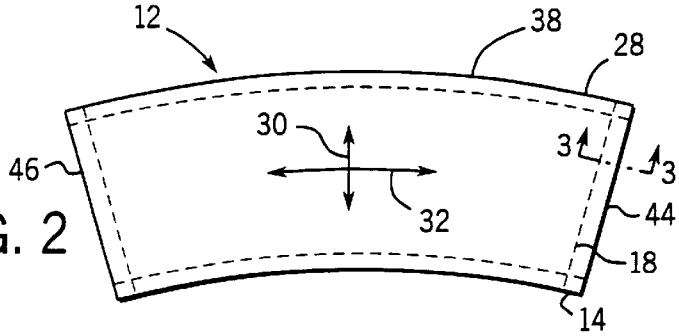
FIG. 2

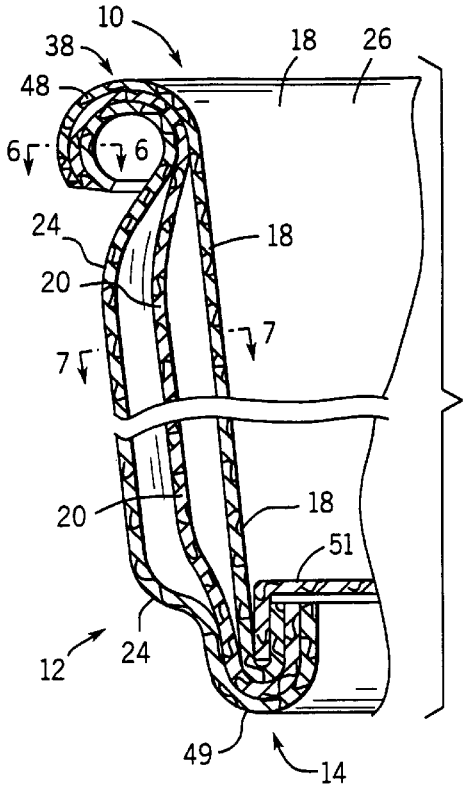
FIG. 5
FIG. 6
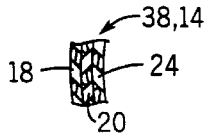
FIG. 7
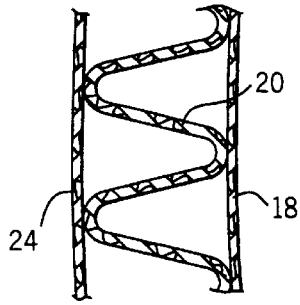
FIG. 8
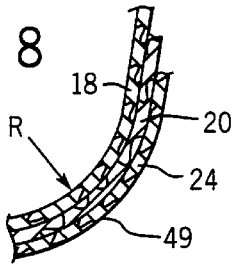
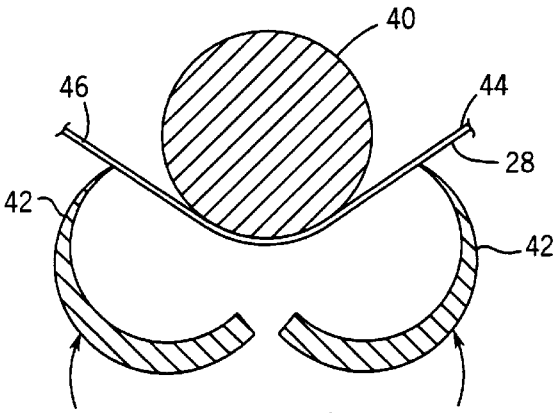
FIG. 10
FIG. 9
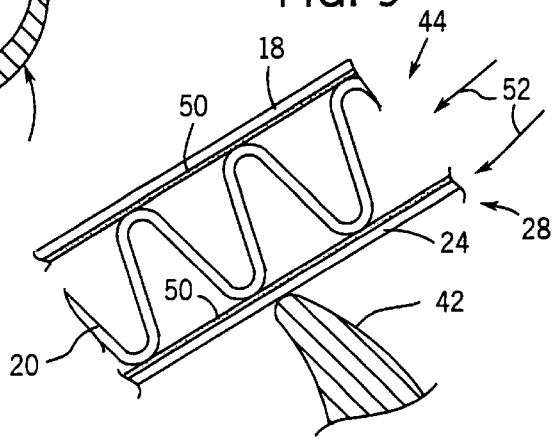

METHOD FOR FORMING A CONTAINER WITH CORRUGATED WALL

CROSS REFERENCE TO RELATED APPLICATIONS

This application is a divisional application of application Ser. No. 08/862,231, now U.S. Pat. No. 5,839,653, filed May 23, 1997 and entitled "Container With Corrugated Wall" and claims the benefit thereof which is a continuation of Ser. No. 08/682,826 filed Jul. 12, 1996 now ABN.

FIELD OF THE INVENTION

The invention relates generally to paper containers and in particular to a container having an insulating wall of corrugated paper.

BACKGROUND OF THE INVENTION

Disposable cups for holding hot beverages may be constructed of expanded polystyrene which provides a cup of relatively low cost with walls having good thermal insulation. The insulating properties of the outer walls of the cup allow the cup to be comfortably held despite the high temperature of its contents. A disadvantage with polystyrene is that it is neither biodegradable, readily recycled nor microwavable.

In contrast, paper cups are both recyclable and biodegradable but such cups, using a single sheet of paper for their outer walls, provide little thermal insulation. It has therefore been proposed to construct the outer wall of a paper cup of multi-ply corrugated paper material, the air trapped between the flutes of the corrugation and the other plies providing sufficient thermal insulation to allow the cup to be comfortably held.

Unfortunately cups using multi-ply corrugated paper material for their outer walls are relatively difficult to manufacture.

SUMMARY OF THE INVENTION

The present invention provides a paper cup having a corrugated outer wall that may be readily manufactured with conventional cup making machinery in a single cycle process. Blanks are cut from a special multi-ply corrugated board having at least one ply having plasticity in a circumferential direction, permitting the corrugated material to be wrapped around a cup-forming mandrel without crushing of the center corrugated ply. Conventional techniques for rolling the cup lip and attaching the bottom to the cup with a rolled seam are made practical by limited crushing the corrugated ply near the upper and lower edge of the outer wall significantly improving the ability of the multi-ply material to be rolled without tearing.

Specifically, the present invention provides a container having a bottom wall and an upstanding wall curved along a circumferential direction to attach at a lower edge to the bottom wall. The upstanding wall includes an inner paper layer, an outer paper layer, and a center corrugated paper layer sandwiched between the inner paper layer and the outer paper layer and having flutes crossing the circumferential direction. At least one of the inner paper layer and the outer paper layer is constructed from a material having circumferential plasticity accommodating changes in inner and outer circumference of the upstanding wall when the upstanding wall is curved from a flat pre-assembled blank. These paper layers may be, for example, be a creped paper layer, a layer of extensible paper or a layer with embossing that may be expanded or compressed.

Thus, it is one object of the invention to provide a corrugated material that can be readily folded into a cup in a single cycle process. The plasticity of the paper layer allows the paper layers to expand or contract in circumference as is necessary for the rolling operation.

The lower edge of the upstanding wall may be pressed so that the corrugated paper layer is flattened and the bottom wall attached to the lower edge by rolling the lower edge around a lip on the bottom wall. An upper edge of the upstanding wall may also be flattened and rolled into a lip.

Thus, it is another object of the invention to permit conventional cup assembly techniques to be used with a multi-ply corrugated material. By flattening the corrugations in the area of rolling, the stretching of the paper in the rolling process is minimized, thereby reducing tearing. The crushed corrugated layer also permits greater slippage between the inner and outer paper layers reducing damaging shear forces within the rolled material.

The foregoing and other objects and advantages of the invention will appear from the following description. In this description, reference is made to the accompanying drawings which form a part hereof and in which there is shown by way of illustration, a preferred embodiment of the invention. Such embodiment does not necessarily represent the full scope of the invention, however, and reference must be made therefore to the claims for interpreting the scope of the invention.

BRIEF DESCRIPTION OF THE DRAWINGS

FIG. 1 is a perspective view of a cup manufactured according to the present invention in partial cut away and showing an outer paper layer peeled away to reveal an inner corrugated layer;

FIG. 2 is a plan view of a blank of corrugated material prior to rolling to form the cup of FIG. 1 showing the direction of the rolling, and an axis of the flutes of the corrugation and showing zones in which the corrugations are flattened for rolling;

FIG. 3 is a cross section through the blank of FIG. 2 in a first embodiment showing a creped outer paper layer;

FIG. 4 is a figure similar to that of FIG. 3 after curvature as is necessary to construct the cup of FIG. 1 and the expansion of the outer layer to permit such curvature;

FIG. 5 is a fragmentary cross section taken along line 5—5 of FIG. 1 showing a forming of the upper lip and attaching of the bottom of the cup;

FIG. 6 is a cross section through FIG. 5 taken along line 6—6 showing the flattening f the corrugated material prior to the forming of FIG. 5;

FIG. 7 is a cross section taken along line 7—7 of FIG. 5 showing the corrugated material without flattening;

FIG. 8 is a detailed view of the corrugated material during rolling to attach to the bottom of the cup showing the slippage between layers permitted by the crushed corrugated layer such as reduces internal shear forces and tearing of the outer layer;

FIG. 9 is a view of slippage of the different lawyers of the corrugated material in a second embodiment of the invention in which a slow setting glue may be used to attach the corrugated elements to one another;

FIG. 10 is a cross section through a cup forming mandrel of a cup manufacturing machine showing a forming of the corrugated material about the mandrel by upwardly moving wings;

FIG. 11 is a cross section similar to FIG. 3 showing a third embodiment with an embossed outer layer;

DETAILED DESCRIPTION OF THE PREFERRED EMBODIMENT

Figure 12:
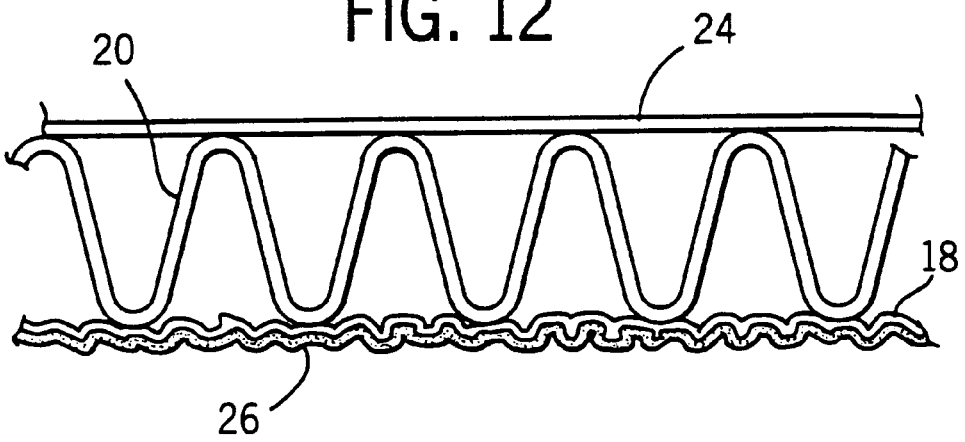
FIG. 12 is a figure similar to that of FIG. 3, showing a fourth embodiment showing a creped inner paper layer.

Referring now to FIG. 1, a cup 10, of the present invention has an upstanding wall 12 rolled into a tube conforming to a frustum of a cone (hereinafter frusto-conical tube) attached at its lower edge 14 to a circular bottom (not shown in FIG. 1) to enclose a beverage receiving volume 16.

The upstanding wall 12 is composed of a corrugated paperboard material having an inner paper layer 18 immediately adjacent to the beverage containing volume 16 which is surrounded by a corrugated paper layer 20 having vertically extending flutes 22. This, corrugated paper layer is in turn, surrounded by an outer paper layer 24 which sandwiches the corrugated paper layer 20 between itself and the inner paper layer 18. An adhesive (not shown) connects the corrugated paper layer 20 to the inner paper layer 18 and the outer paper layer 24 according to methods well-known in the art. The inner paper layer 18 is coated with a thin water resistant coating 26 to provide protection of the inner paper layer 18 from hot liquid that may be held within the volume 16. In the preferred embodiment, the coating 26 is a pulpable acrylic permitting the cup to be easily recycled. Such coatings are available under the tradename Spectra-Guard 763HS from the Spectra-Kote company of Gettysburg, Pa. as described in U.S. Pat. Nos. 5,393,566; 5,429,294; and 5,531,863 hereby incorporated by reference. It will be understood that a variety of moisture resistant materials including wax and acrylics can be used to provide this protection.

Referring now to FIG. 4, the upstanding wall 12, before it is rolled into a cup as shown in FIG. 1, is cut from a blank 28 of corrugated material into a sector of an annulus thereby to roll into the frusto-conical shape of FIG. 1. The flutes of the corrugations lie generally along a vertical axis 30 extending along a line of radius of the annulus whereas the bending of the blank 28 into the frusto-conical shape is along a circumferential direction 32 crossing the vertical axis 30.

Referring now to FIG. 3, in a first embodiment, the outer paper layer 24 of the corrugated blank 28 is constructed of an extensible paper that will lengthen under tension along the circumferential direction 32. Such paper may be a creped paper having multiple randomly formed creases and folds that under tension straighten to allow the outer paper layer 24 to expand as described. Alternatively, in a second embodiment (not shown) the outer paper layer 24 may be a so-called extensible craft paper which provides a stretching at the fiber level of the paper. Extensible Kraft is commercially available under the tradename of XKL extensible from Thilmany Pulp and Paper Company of Kaukauna, Wis. Referring to FIG. 11, in a third embodiment, the outer paper layer 24 may also be a paper with embossing 25, where the embossing 25 may flatten when the paper is put under tension allowing the paper to lengthen. Other extensible materials may also be used as will be apparent from this description to those of ordinary skill in the art.

Referring now to FIG. 4, when the blank 28 is rolled as indicated by arrows 34 into a frusto-conical shape, the outer paper layer 24 may expand along the circumferential direction 32 to permit the rolling without tearing of the outer paper layer 24 or a crushing of the flutes of the corrugated paper layer 20. The expansion of the outer paper layer 24 is necessary because of the substantially greater thickness of the blank 28 than a single sheet of paper normally used for the upstanding wall 12 of a cup. This greater thickness of wall material displaces the outer paper layer 24 to a greater radius than the inner paper layer 18 requiring a significant increase in the circumferential length of the outer paper layer 24. An expansion of the outer paper layer 24 of 2 to 15% is believed to be adequate for most standard container sizes with necessary thickness of the corrugated material.

Figure 13:
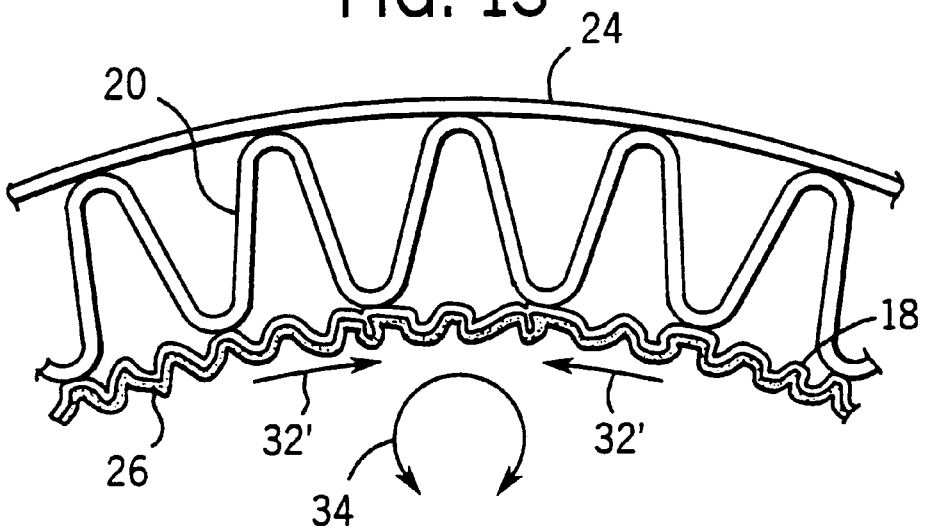
FIG. 13 is a figure similar to that of FIG. 4 showing compression of the inner paper layer to permit curvature of the blank.

Referring now to FIGS. 12 and 13, in a fourth embodiment, the inner layer 18 may be a creped or embossed paper. When the blank 28 is rolled as indicated by arrows 34 into a frusto-conical shape, the inner paper layer 18 may compress along the circumferential direction 32' to permit the rolling without tearing of the outer paper layer 24 or a crushing of the flutes of the corrugated paper layer 20. In this embodiment, the compression of the inner paper layer 18, rather than an expansion of the outer paper layer 24 accommodates the difference in circumferences of the inner paper layer 18 and outer paper layer 24 as the blank 28 is rolled. Again, a compression of the inner paper layer 18 of 2 to 15% is believed to be adequate for most standard container sizes with necessary thickness of the corrugated material.

The ability of the paper layers to change circumferential dimension, either by expansion or compression, as the cup is rolled by the requisite amount will be termed circumferential plasticity. It will be recognized that both the inner and outer paper layers may be constructed of paper exhibiting circumferential plasticity and in this case the amount of plasticity for each layer may be reduced from that required when only a single layer having circumferential plasticity is used.

Referring again to FIG. 2, prior to folding the blank 28 and assembling it into a cup 10, the flutes 22 (not shown in FIG. 2) are crushed flat in a strip along the lower edge 14 and upper edge 38 of the blank 28. This flattening reduces the thickness of the corrugated paper layer 20 (as shown in FIG. 6) prior to it being folded into a cup and can be performed in a single operation during the die cutting of the blank by including anvils within the knife blade of the die to flatten the edges 14 and 38. Similarly, the flutes 22 are crushed flat in strips along the left and right edges 46 and 44 to permit sealing these edges together as will be described.

Referring now to FIG. 10, the blank 28 is folded about a frusto-conical mandrel 40 by conforming wings 42 in a cup making machine well-known in the art. When the folding is complete, left and right edges 44 and 46 of the blank 28 abut and are sealed together by a heat sealing process or adhesive such as is well known in the art.

Next, and referring to FIG. 5, the crushed upper edge 38 of the upstanding wall 12 is rolled outward to form a lip 48 according to conventional paper cup construction techniques. Also the lower edge 14 is rolled about a downward extending lip on the periphery of the disked shaped bottom 51 to form a seal 49 against leakage of the contained beverage. The seal 49 is formed by heat sealing the lower edge 14 to the bottom 51 or attaching it with adhesive.

Referring to FIG. 6, the crushing of the upper and lower edges 14 and 38 reduces the difference in radius between the inner paper layer 18 and the outer paper layer 24 in the folding of the lip 48 and the bottom seal 49 thus reducing the difference in the circumference of these two layers at the lip 48 and the seal 49 and the tendency of the outer paper layer 24 in the seal 49 and the inner paper layer 18 in the lip 48 to tear. With respect to the seal 49, the extensible material of the outer paper layer 24 may also expand along the vertical axis 30 further reducing this tendency of the outer paper layer 24 to tear upon stretching.

Although the inventor does not wish to be bound by a particular theory, it is believed that, in both the cases of the lip 48 and the seal 49, the crushed corrugated paper layer 20 facilitates a displacement, upon rolling, between the layers 18 and 24. Referring to FIG. 8, by permitting a degree of displacement between layers 18 and 24 in the seal 49, the stretching of the outer paper layer 24 necessary for the folding operation is reduced. A similar effect occurs with respect to the opposite direction rolling of the lip 48.

Referring to FIG. 7, because the crushing of the upper edge 38 and lower edge 14 is restricted to the region of the lip 48 and seal 49, the thermal properties of the majority of the outer surface of the upstanding wall 12 are preserved, in particular, the air spaces between the corrugated paper layer 20 and the layers 18 and 24.

In another embodiment of the invention, shown generally in FIG. 9, this same principle of permitting a sliding between the inner paper layer 18 and outer paper layer 24 may be invoked to permit the forming of the blank 28 around the mandrel 40 with a reduced or minimal need for expansion of the outer paper layer 24. In this embodiment, a slow setting adhesive 50 is used to assemble the components of the blank 28 together. In particular, the opposed surfaces of layer 18 and layer 24 are coated with a slow setting adhesive 50 and the blank 28 is rolled about the mandrel 40. At the time that the wings 42 form the blank 28 around the mandrel 40, the variation between the circumference necessary from the inner paper layer 18 and outer paper layer 24 is accommodated by relative slippage shown by arrows 52 between the corrugated paper layer 20 and the inner paper layer 18 and the corrugated paper layer 20 and the outer paper layer 24. A misalignment in the left and right edges 44 and 46 of the inner paper layer 18 and outer paper layer 24, respectively, at a point of seaming, is relatively minor and may be accommodated by crushing and heat sealing all layers 18 and 24 of both edges 44 and 46 together at the seam line. Alternatively, the outer paper layer 24 of the blank may be cut to be larger than the inner paper layer 18 and the corrugated paper layer 20. The slight loss in thermal resistance at this seam caused by the crushing out of the air space between the layers is offset by the seam which comprises six layers of paper material.

Adhesives 50 suitable for this purpose and the control of the setting time of the adhesives is well understood in the art.

Normally moisture protection is required for the outer paper layer 24 when the cup will be used for cold beverages as a result of condensation forming on the outer surfaces. However, in the present cup, the thermal insulating properties of the corrugated blank greatly reduces such condensation. Nevertheless, the outer surface of outer paper layer 24 may also be coated with a water resistant material.

The above description has been that of a preferred embodiment of the present invention. It will occur to those that practice the art that many modifications may be made without departing from the spirit and scope of the invention. In order to apprise the public of the various embodiments that may fall within the scope of the invention, the following claims are made:

I claim:

1. A method of manufacturing a paper container from a premanufactured, substantially planar corrugated paperboard having a first outside paper layer, a second outside paper layer glued respectively face to face on either side of a center corrugated paper layer to laminate the center corrugated paper layer between the first outside paper layer and the second outside paper layer, the center corrugated paper layer having flutes along a vertical axis comprising the following sequential steps of:

(a) cutting a blank from the premanufactured corrugated paperboard;

(b) rolling the cut blank of corrugated paperboard along a circumferential axis crossing the vertical axis; and (c) attaching a bottom wall to a lower curved edge of the rolled and cut corrugated paperboard blank.

2. The method of claim 1 including the step of:

crushing the lower curved edge of the corrugated paper board so that the corrugated paper layer is flattened; and wherein the step of attaching the bottom wall to the curved edge of the rolled corrugated paper board includes the step of rolling the curved edge around a lip on the bottom wall.

3. The method of claim 1 including the step of:

crushing an upper curved edge of the corrugated paper board opposite the lower curved edge so that the corrugated paper layer is flattened;

and including the step of rolling the upper curved edge into a lip.

4. A method of claim 1 wherein the blank of corrugated paperboard has an upper and lower opposed edge and including the step of:

crushing the upper and lower opposed edge of the corrugated paperboard; and sealing the upper and lower opposed edge together after step (b).

5. A method of manufacturing a paper container comprising the following sequential steps of:

(a) forming a substantially planar corrugated paperboard having a first outside paper layer, a second outside paper layer each glued face to face on opposite sides of a center corrugated paper layer to laminate the center corrugated layer between the first outside paper layer and second outside paper layer, the center corrugated paper layer having flutes extending along a flute axis;

(b) cutting a blank from the corrugated paperboard;

(c) rolling the blank of corrugated paperboard to curve along a circumference crossing the flute axis so as to provide for a relative increase in a circumferential diameter of the first outer paper layer with respect to a circumferential diameter of the second outer paper layer so as to provide a closed tube with the second paper layer on an inner surface without crushing of the flutes of the center corrugated paper layer; and (d) attaching a bottom wall to a lower curved edge of the rolled corrugated paperboard.

* * * * *